US010168055B2

(12) United States Patent
Brunner et al.

(10) Patent No.: US 10,168,055 B2
(45) Date of Patent: Jan. 1, 2019

(54) HOUSEHOLD DEVICE HAVING A DOOR AND ELECTRICAL CONTACTS IN THE REGION OF A DOOR GUIDE

(71) Applicant: BSH Hausgeräte GmbH, Munich (DE)

(72) Inventors: Martin Brunner, Pforzheim (DE); Thomas Dankwardt, Karlsruhe (DE); Manfred Hintermayer, Karlsruhe (DE); Nils Platt, Linkenheim-Hochstetten (DE); Thorsten Rausch, Karlsruhe (DE); Marco Weinkötz, Bretten (DE); Reinhard Wiedenmann, Weingarten (DE)

(73) Assignee: BSH Hausgeräte GmbH, Munich (DE)

( * ) Notice: Subject to any disclaimer, the term of this patent is extended or adjusted under 35 U.S.C. 154(b) by 79 days.

(21) Appl. No.: 15/502,510

(22) PCT Filed: Aug. 12, 2015

(86) PCT No.: PCT/EP2015/068547
§ 371 (c)(1),
(2) Date: Feb. 8, 2017

(87) PCT Pub. No.: WO2016/026747
PCT Pub. Date: Feb. 25, 2016

(65) Prior Publication Data

US 2017/0241647 A1 Aug. 24, 2017

(30) Foreign Application Priority Data

Aug. 19, 2014 (DE) ..... 10 2014 216 411

(51) Int. Cl.
*F25D 27/00* (2006.01)
*F25D 23/02* (2006.01)
(Continued)

(52) U.S. Cl.
CPC ..... *F24C 15/026* (2013.01); *F24C 15/023* (2013.01); *F25D 23/028* (2013.01); *F25D 27/00* (2013.01)

(58) Field of Classification Search
CPC ..... F24C 15/00; F24C 15/02; F24C 15/026; F24C 15/028; F25D 23/028; F25D 23/02
See application file for complete search history.

(56) References Cited

U.S. PATENT DOCUMENTS 4,283,097 A * 8/1981 Lundblad ..... G07F 9/06 109/52
6,295,004 B1 * 9/2001 Burnett ..... A47L 15/4257 134/113

(Continued)

FOREIGN PATENT DOCUMENTS

DE 102007015237 A1 10/2008
DE 102007057767 A1 6/2009

(Continued)

OTHER PUBLICATIONS

National Search Report DE 10 2014 216 411.7 dated Apr. 14, 2016.
International Search Report PCT/EP2015/068547 dated Oct. 22, 2015.

*Primary Examiner* — Kimberley S Wright
(74) *Attorney, Agent, or Firm* — Michael E. Tschupp; Andre Pallapies; Brandon G. Braun

(57) ABSTRACT

A household appliance includes a housing having a receiving space for food and a storage space disposed below the receiving space. A door for closing an opening of the receiving space of the housing is insertable into the storage place when the door is opened and includes at least one electrical consumer, a first electrical contact coupled to the electrical consumer, and a housing-side second electrical contact electrically coupled to the first electrical contact for supply of electrical energy to the consumer as a function of (Continued)

an operating position of the door. The door is guided into the storage space by a guide apparatus which has a housing-side horizontal guide slot arranged laterally in relation to the door in a side wall of the storage space. The second electrical contact is arranged adjacent to the guide slot in the side wall of the storage space.

13 Claims, 5 Drawing Sheets

(51) Int. Cl.
*F21V 33/00* (2006.01)
*F24C 15/02* (2006.01)

(56) References Cited

U.S. PATENT DOCUMENTS 6,719,383 B2 * 4/2004 Elick ..... A47L 15/4257 312/228
7,731,806 B2 * 6/2010 Hapke ..... A47L 15/4259 134/57 DL
8,047,198 B2 * 11/2011 Meyer ..... F24C 15/026 126/190
8,360,802 B2 * 1/2013 Allard ..... F25D 23/00 312/223.6
8,870,405 B2 * 10/2014 Chung ..... F21V 33/0012 362/133
9,404,287 B2 * 8/2016 Lepie ..... E05B 43/00
9,534,829 B2 * 1/2017 Held ..... F25D 23/028
2001/0009256 A1 * 7/2001 Nasu ..... F24C 7/082 219/739
2005/0134158 A1 * 6/2005 Bartmann ..... F24C 15/023 312/319.2
2005/0245413 A1 * 11/2005 Baltes ..... A47L 15/0049 510/224
2007/0133344 A1 * 6/2007 Bronstering ..... F24C 7/085 366/146
2009/0013986 A1 * 1/2009 Meyer ..... F24C 15/023 126/194
2009/0039068 A1 * 2/2009 Boutwell ..... F24C 7/08 219/220
2010/0140247 A1 * 6/2010 Watkins ..... F24C 7/00 219/391
2014/0190083 A1 * 7/2014 Lepie ..... E05B 43/00 49/30
2015/0338156 A1 * 11/2015 Held ..... F25D 23/028 312/405

FOREIGN PATENT DOCUMENTS

DE 102011086970 A1 5/2013
EP 2189725 A2 * 5/2010 ..... F24C 15/023
EP 2741014 A2 * 6/2014 ..... F24C 15/026

* cited by examiner

HOUSEHOLD DEVICE HAVING A DOOR AND ELECTRICAL CONTACTS IN THE REGION OF A DOOR GUIDE

CROSS-REFERENCES TO RELATED APPLICATIONS

This application is the U.S. National Stage of International Application No. PCT/EP2015/068547, filed Aug. 12, 2015, which designated the United States and has been published as International Publication No. WO 2016/026747 A1 and which claims the priority of German Patent Application, Serial No. 10 2014 216 411.7, filed Aug. 19, 2014, pursuant to 35 U.S.C. 119(a)-(d).

BACKGROUND OF THE INVENTION

The invention relates to a household appliance with a door for closing an opening of a receiving space configured to hold food in a housing of the household appliance. The household appliance also comprises a storage space below the receiving space, it being possible for the door to be introduced into said storage space when opened. The door comprises at least one electrical consumer and a first electrical contact that can be coupled to the electrical consumer. At least one second electrical contact is also arranged on the housing side and can be electrically coupled to the first electrical contact to supply electrical energy to the consumer as a function of an operating position of the door.

Such an embodiment of a household appliance is known for example from DE 10 2007 057 767 B4. This describes such a lowered door in a cooking appliance, in particular an oven, as well as door-side and housing-side electrical contacts, which are coupled to one another as a function of the door position so that a light source configured as an electrical consumer is supplied with current. The electrical contacts here are configured on specific support elements.

A door of a household appliance that can be lowered in a storage space is also known from DE 10 2011 086 970 A1, with a specific guide apparatus shown there.

BRIEF SUMMARY OF THE INVENTION

It is the object of the present invention to create a household appliance in which electrical contact with contacts, which are configured on the housing side and door side and coupled to one another as a function of a door position in order to be able to supply energy to a door-side electrical consumer, is improved.

An inventive household appliance comprises a door for closing an opening of a receiving space configured in a housing of the household appliance. When opened, the door can be introduced into a storage space of the household appliance, which is configured below the receiving space. This results in a door which can be, as it were, lowered. The door comprises at least one electrical consumer and a first electrical contact that can be coupled to the electrical consumer. At least one second electrical contact is arranged on the housing side and can be electrically coupled to the first electrical contact to supply electrical energy to the consumer as a function of an operating position of the door. One important concept of the invention is that, to introduce the door into the storage space, a guide apparatus is configured in a storage space side wall with at least one housing-side guide slot configured laterally in relation to the door in a horizontal direction of the household appliance, the housing-side second electrical contact being arranged adjacent to the guide slot in the storage space side wall. Such specific spatial positioning of said housing-side electrical contact simplifies and improves the guiding of the movement of the door and allows the electrical contact to be configured and arranged in a very compact manner, with the result that the layout of the electrical contacts no longer requires a lot of space. It allows a very reliable and highly precise coupling of the electrical contacts as required.

Provision is made in particular for the guide apparatus to have a door-side guide path, which is configured on a narrow edge face of the door facing the storage space side wall and in which the door-side first contact is arranged. With this embodiment the door-side contact is arranged in such a manner that it is protected to a certain degree and it can also be positioned in a mechanically stable manner. The forces acting as a result during door movement as the electrical contacts are coupled and decoupled are also prevented from impairing this first door-side contact, thereby allowing permanent secure and reliable functionality of said door-side contact.

Provision is preferably made for the first electrical contact to be arranged in an arm wall of the guide path of the guide apparatus with its U-shaped cross section. This is a preferred position, as it means that the movement of elements engaging in the guide path is also not impaired and the advantages described above in relation to the first contact are also enhanced.

Provision is preferably made for the first electrical contact to be configured at a lower end of the guide path. This positional arrangement allows coupling or decoupling of the contacts in quite specific door positions. In particular contact with the electrical contacts is only achieved when the door is almost closed, with the energization of the electrical consumer only then being permitted, thereby achieving energy-saving operation of the household appliance.

Provision can however also be made for the first electrical contact to be configured in a number of other positions in the guide path and also to be positioned further away from the lower end in the direction of an upper end in this respect.

Provision is preferably made for the first electrical contact and the second electrical contact to make maximum contact in respect of surface and with regard to their mutual contact as a result of force when the door is in the closed state.

Provision is preferably made for the first electrical contact to be rigid and therefore configured to be extremely stable in respect of shape. This improves contact with the second electrical contact.

Provision is preferably made for the second electrical contact to be configured as resilient. This is particularly advantageous as it means that when the door moves, the second electrical contact can change position, in particular be deflected, at least partially and also contact with the first electrical contact is improved so that the mechanical forces and friction that result during contact do not result in unwanted damage to the contacts and stable contact can also be achieved in the contacted end state.

Provision is preferably made for a hinge with a hinge rocker arranged rotatably on the housing to be arranged on the housing side, at least one guide element being arranged on said hinge rocker and engaging with a guide path on the door to guide the lowering movement.

Provision is preferably made for the hinge rocker to be arranged in such a manner that it can be pivoted along a pivot path toward the storage space side wall and the second electrical contact, the second electrical contact being arranged in the pivot path of the hinge rocker. This specific embodiment of the hinge and the specific positional arrangement of the second electrical contact allow the movement of the door to be guided in a preferred manner and the hinge, in particular the hinge rocker itself, as it were allows mechanical contact to be achieved between the hinge rocker and the second electrical contact during pivoting when the door has covered a specific distance and, particularly when the second electrical contact is configured as resilient, the hinge rocker can exert a force on the second electrical contact, which is then in particular pushed in a defined direction. On the one hand this allows a very compact and space-saving embodiment to be achieved which still allows movement of the door without impairment. On the other hand however it also favors electrical contact with the contacts. This is brought about, as it were, automatically by the hinge rocker when the door performs the pivot movement.

Provision is preferably made for a decoupling element to be arranged on the hinge rocker and to be able to decouple the coupled state of the first electrical contact to the second electrical contact automatically when the door is lowered into the storage space and the hinge rocker is thereby pivoted along the pivot path.

Provision can be made for the electrical contacts to be coated, at least in parts, with a metal, in particular gold or brass. This reduces the noise produced during coupling and decoupling and also improves smooth running when the door is moved.

Provision is preferably made for the second electrical contact to be configured as an S-shaped strip. In particular when the second electrical contact is also configured as resilient, this specific shape favors coupling to the hinge rocker, when part of said second electrical contact with its specific shape extends into the pivot path, and it also allows very specific pushing to the side by the hinge rocker as the movement of the door continues. This specific shape also improves the mechanical and therefore the resulting electrical contact with the first electrical contact and allows particularly stable contact between the electrical contacts to be achieved in the coupled state.

Provision is therefore made with the invention for the electrical contacts no longer to be arranged on a base plate at a distance from lateral storage space side walls but for them to be positioned together precisely on said storage space side walls and therefore laterally in relation to the door.

The housing-side electrical contacts are connected to a control unit of the household appliance and conduct the electric current to the door-side contacts by way of their contact surfaces.

The at least one electrical consumer is preferably a light source.

The contact surface of the housing-side second electrical contact preferably has a defined length in the movement direction of the door, by way of which the switching time point for the electrical consumer is then also set in conjunction with the electronic control unit.

These housing-side second electrical resilient contacts are also configured to compensate for the tolerances and position of the door and they can then also avoid the inward bound or inward pivoted door and the corresponding hinges. This would not be possible with a rigid contact so the corresponding functional principle could not be achieved with a rigid housing-side contact. This also means that the door can be fitted and removed without having to take out the housing-side contacts.

Because the decoupling element discussed above is advantageously present on the hinge rocker, disturbance and noise can also be brought about when the door performs a pivot movement in respect of coupling and decoupling with the housing-side second electrical contact, as said second electrical contact in particular does not bounce on the individual elements, which said electrical contact then has to avoid.

Provision can be made for the decoupling element to be configured in an integrated manner in the hinge rocker or to be present as a separate part. Provision can also be made for the door-side first electrical contact also to be configured as resilient, at least in parts.

The invention also in particular significantly reduces, in particular avoids, the possibility of a short circuit between the electrical contacts, which is particularly advantageous specifically for household appliances configured as steam cooking appliances, as it is known that steam and therefore also condensate can occur in these during operation. A reliable transfer of current to the door is also possible even when there are major positional inaccuracies in the door in all directions. This spatially specific positioning of the electrical contacts also means that they are not directly visible and they cannot therefore be touched directly, thereby significantly increasing safety.

Further features of the invention will emerge from the claims, figures and description of the figures. The features and feature combinations set out above in the description and the features and feature combinations set out in the following in the description of the figures and/or simply shown in the figures can be used not only in the combination specified in each instance but also in other combinations or alone, without departing from the scope of the invention. Embodiments of the invention which are not shown and described specifically in the figures but will emerge from and can be produced by separate feature combinations from the described embodiments should therefore also be deemed to be covered and disclosed.

BRIEF DESCRIPTION OF THE DRAWINGS

Exemplary embodiments of the invention are described in more detail below with reference to schematic drawings, in which.

DETAILED DESCRIPTION OF EXEMPLARY EMBODIMENTS OF THE PRESENT INVENTION

Figure 1:
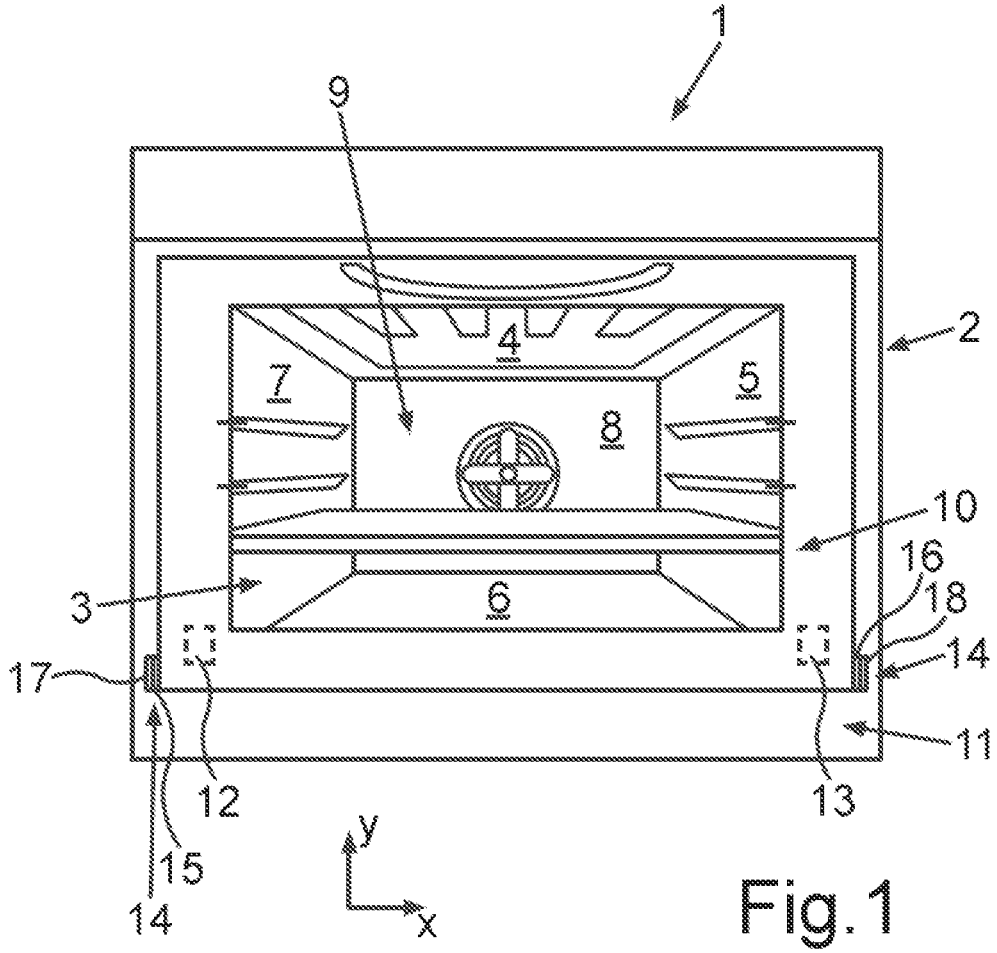
FIG. 1 shows a front view of an exemplary embodiment of an inventive household appliance.

Identical elements and those of identical function are shown with the same reference characters in the figures.

FIG. 1 shows a front view of a household appliance 1, which is configured for the preparation of food and can be for example an oven or a steam cooking appliance or a microwave cooking appliance. The household appliance 1 comprises a housing 2, in which a muffle 3 is arranged, the walls 4, 5, 6, 7 and 8 of which delimit a receiving space for food, in particular a cooking chamber 9.

The household appliance 1 also comprises a door 10, which is configured to close the front face of a loading opening in the muffle 3 and therefore also in the cooking chamber 9.

A storage space 11 is also configured in the housing 2 below the cooking chamber 9 and therefore also below the wall 6 of the muffle 3 configured as the base when viewed in the vertical direction and thus in the heightwise direction of the household appliance 1. The door 10, which can be lowered, can be inserted into this and stowed therein when opened. The door 10 can therefore be introduced into said storage space 11.

The door 10 also comprises at least one electrical consumer, with two electrical consumers 12 and 13 being arranged solely by way of example in respect of position and number in the door 10 in the exemplary embodiment, said electrical consumers 12 and 13 being light sources.

A guide apparatus 14 is also configured, comprising both door-side and housing-side elements, the door 10 being guided on its path into the storage space 11 and out of the storage space 11 by means of the guide apparatus 14.

The household appliance 1 also comprises at least one door-side first electrical contact 15, a further first electrical contact 16 being configured on the door side in the exemplary embodiment. These electrical contacts 15 and 16 can be or are coupled to the electrical consumers 12 and 13. A second electrical contact 17 and in the exemplary embodiment a further second electrical contact 18 are also configured on the housing side and therefore externally in relation to the door 10.

Provision is made for it to be possible for the second electrical contacts 17 and 18 to be electrically coupled to the first electrical contacts 15 and 16 to supply electrical energy to the consumers 12 and 13 as a function of an operating position of the door 10.

Figure 2:
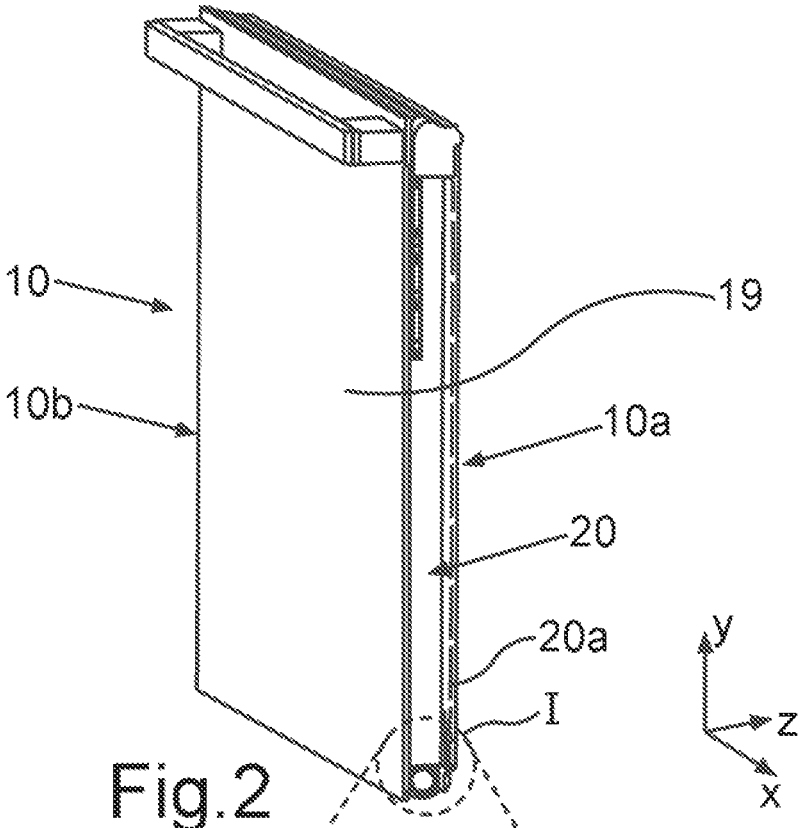
FIG. 2 shows a perspective view of a door of the household appliance from FIG. 1.
Figure 3:
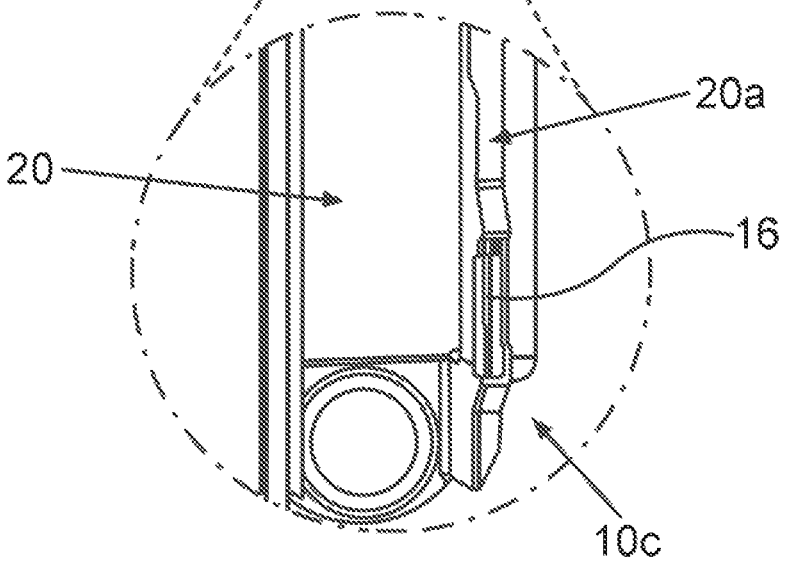
FIG. 3 shows an enlargement of a partial section of the door from FIG. 2.

FIG. 2 shows a perspective view of the door 10. The door 10 comprises a plate-type base part 19, with a door-side guide path being configured on each of its opposing vertical narrow faces or strip-type edges 10*a* and 10*b*. Said guide path 20 is configured as U-shaped in cross section and therefore in a section in the x-z plane. Provision is made here for the first electrical contact 16 to be arranged on, in particular embedded in, an arm 20*a* facing the cooking chamber 9 when the door 10 is in the closed state, as shown in an enlarged partial section I in FIG. 2. This first electrical contact 16 is therefore configured at a lower end 10*c* of the door 10 in the exemplary embodiment.

Figure 4:
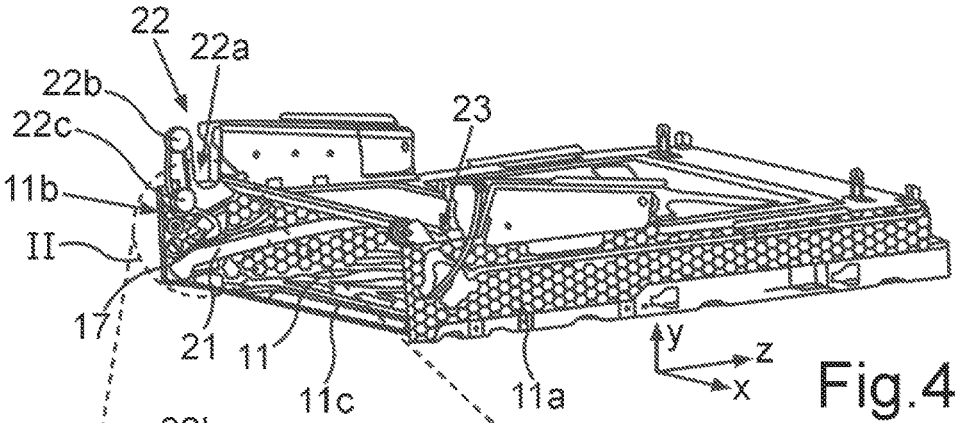
FIG. 4 shows a perspective diagram of a storage space and further subcomponents of the household appliance.

FIG. 4 shows a perspective diagram of a subregion of the housing 2 in the region of the storage space 11. Said storage space 11 has lateral vertical storage space side walls 11*a* and 11*b* and also comprises a storage space base 11*c*. A guide slot 21 is configured in each of the storage space side walls 11*a* and 11*b*, forming components of the guide apparatus 14.

FIG. 4 shows exemplary hinges 22 and 23, which are coupled to the door 10 so that the pivot movement of the door 10 as it opens and closes and the lowering movement or displacement of the door 10 into the storage space 11 or out of the storage space 11 are guided. To this end the hinge 22 comprises a hinge rocker 22*a*, on which two guide rollers 22*b* and 22*c* are arranged in a rotatably supported manner by way of example. The hinge rocker 22*a* can also be pivoted about a horizontal axis, said horizontal axis running parallel to roller axes of the rollers 22*b* and 22*c*.

The guide slots 21 are configured laterally in relation to the door 10 in a horizontal direction and therefore in the x direction of the household appliance 1.

Provision is also made for the housing-side second electrical contacts 17 and 18 to be arranged adjacent to, in particular above, the respective guide slots 21 in the storage space side walls 11*a* and 11*b*.

Provision is made in the exemplary embodiment for the first electrical contacts 15 and 16 to be rigid and for the second electrical contacts 17 and 18 to be configured as resilient.

Figure 5:
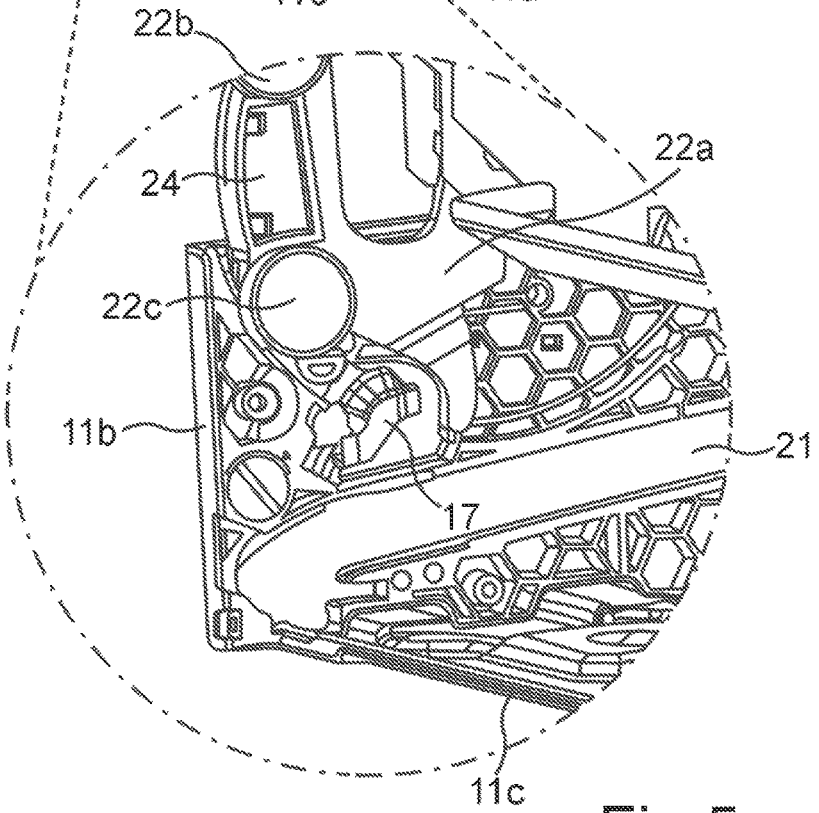
FIG. 5 shows an enlargement of a partial section from FIG. 4.

As shown already in FIG. 4 and also in FIG. 5, which shows an enlarged partial diagram of the section II in FIG. 4, the hinges 22, 23 move with their hinge rockers 22*a* essentially in vertical planes and thus in y-z planes when the door 10 is opened or closed and therefore pivoted. This produces a pivot path, which extends in particular in the y-z plane. The hinge rocker 22*a* is thus arranged such that it can be pivoted along such a pivot path toward the storage space side wall 11*b* and thus also toward the second electrical contact 17, which is in particular fastened there, the second electrical contact 17 being arranged in the pivot path of the hinge rocker 22.

In the exemplary embodiment a decoupling element 24 is arranged on the hinge rocker 22*a* and can be used to produce the coupled state of the first electrical contact 15 to the second electrical contact 17 automatically, when the hinge rocker 22*a* moves on said pivot path and therefore also crosses and makes contact mechanically with the second electrical contact 17. This happens when the door 10 is lowered into the storage space 11 and the hinge rocker 22*a* is pivoted along the pivot path as it does so, decoupling the hitherto coupled state of the electrical contacts 15 and 17 on the path into the storage space 11. The opposite side is correspondingly configured with the embodiment of a hinge rocker of the hinge 23 and the contacts 16 and 18 there.

Figure 6:
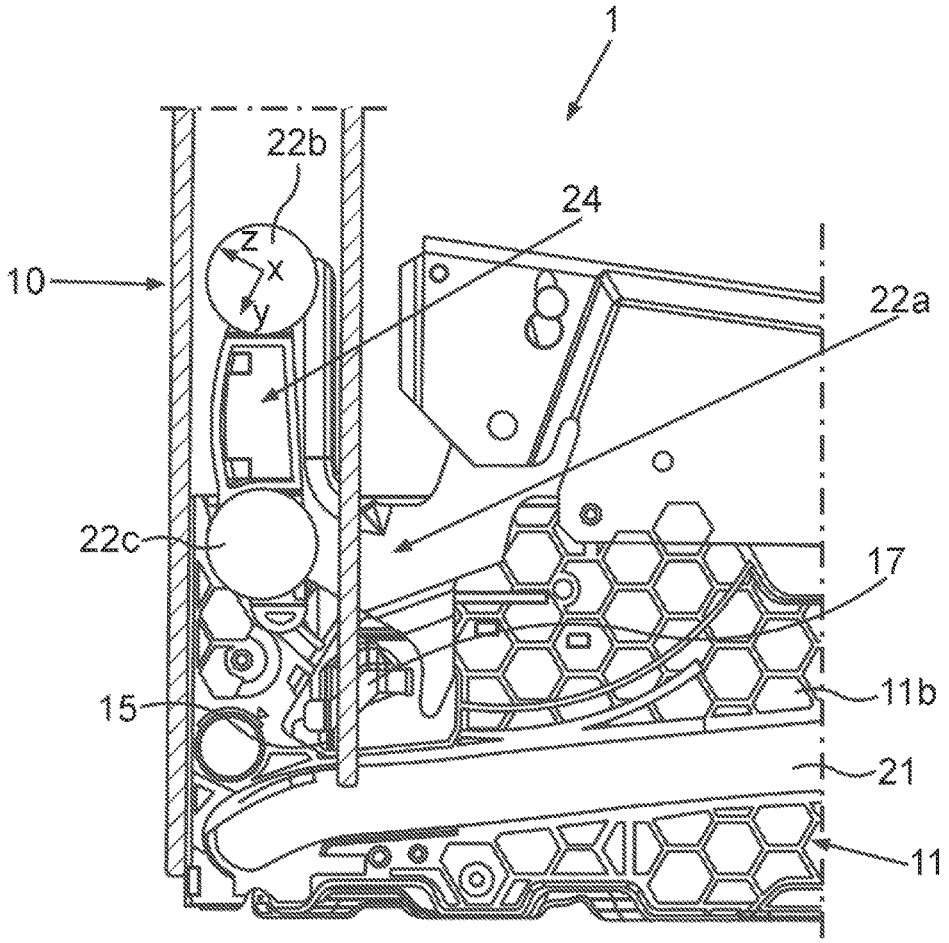
FIG. 6 shows an enlarged partial diagram of the household appliance in the region of the door and the storage space with the door closed.

FIG. 6 shows a partial diagram in the section in the y-z plane of the household appliance 1 in the region of the door 10 and the storage space 11. In FIG. 6 the door 10 is fully closed. When the door 10 is in this closed state, the electrical contacts 15 and 17 are in maximum contact with one another and therefore both the mechanical and the resulting electrical contact are achieved. As also shown in particular in FIG. 5 and the following FIG. 7, in one preferred embodiment provision is made for the housing-side electrical second contacts 17 and 18 to be configured as S-shaped.

The contacts 15 to 18 are also coated, at least in parts, with gold or brass or the like.

Figure 7:
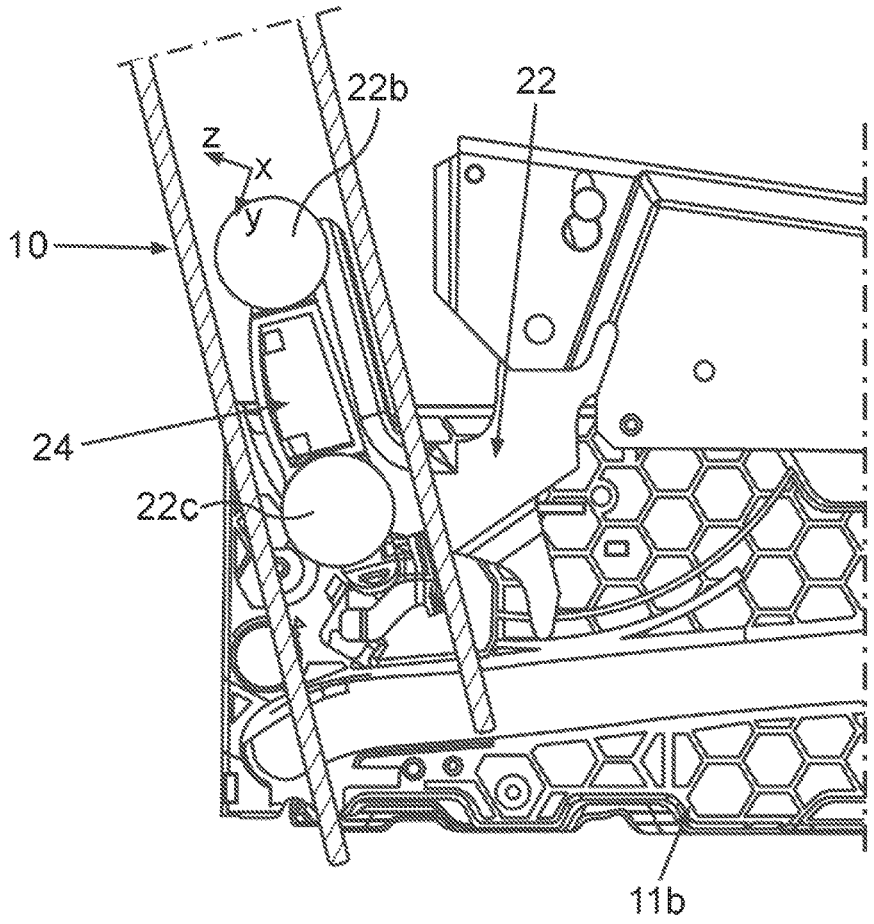
FIG. 7 shows the diagram from FIG. 6 but with the door already partially open.

Based on the diagram in FIG. 6, when the door 10 is opened, the hinge rocker 22*a* also performs a pivot movement, as shown in FIG. 7. The opening of the door 10 and the resulting pivot movement cause the decoupling element 24 to reach and make mechanical contact with the second housing-side electrical contact 17 in the pivot path as the pivot movement of the door 10 continues and the hinge rocker 22*a* therefore also moves along the pivot path and the further movement and opening of the door 10 cause said second electrical contact 17 to be pushed to the side and the contact between the electrical contacts 15 and 17 to be canceled or released. Said decoupling element 24 pushes the slot contact or the slot contact spring or the second electrical contact 17 to be pushed out of the movement region of the door 10 and hinge 22 so the latter can continue its pivot movement.

The invention claimed is:

1. A household appliance, comprising:

a housing having a receiving space for food and a storage space disposed below the receiving space;

a door for closing an opening of the receiving space of the housing, said door being configured for insertion into the storage place when the door is opened, said door including at least one electrical consumer, a first electrical contact coupled to the electrical consumer, and a housing-side second electrical contact electrically coupled to the first electrical contact for supply of electrical energy to the consumer as a function of an operating position of the door;

a guide apparatus configured to guide the door into the storage space, said guide apparatus having a housing-side horizontal guide slot arranged laterally in relation to the door in a side wall of the storage space, said second electrical contact being arranged adjacent to the guide slot in the side wall of the storage space the guide apparatus has a door-side guide path formed on a narrow edge side of the door in facing relation to the side wall of the storage space;

a housing-side hinge having a hinge rocker arranged rotatably on the housing, said hinge rocker having arranged thereon at least one guide element to engage in the guide path on the door so as to guide a lowering movement of the door; and a decoupling element arranged on the hinge rocker and configured to automatically decouple a coupled state of the first electrical contact to the second electrical contact when the door is lowered into the storage space and the hinge rocker is pivoted along a pivot path.

2. The household appliance of claim 1, wherein said first electrical contact of the door is arranged in the guide path.

3. The household appliance of claim 2, wherein the guide path has a U-shaped cross section to define an arm wall, said first electrical contact being arranged in the arm wall of the guide path.

4. The household appliance of claim 2, wherein the first electrical contact is formed at a lower end of the guide path.

5. The household appliance of claim 1, wherein the first and the second electrical contacts are configured to make maximum contact when the door is closed.

6. The household appliance of claim 1, wherein the first electrical contact is rigid.

7. The household appliance of claim 1, wherein the second electrical contact is resilient.

8. The household appliance of claim 1, wherein the hinge rocker is configured for pivoting along the pivot path toward the side wall of the storage space and the second electrical contact, said second electrical contact being arranged in the pivot path of the hinge rocker.

9. The household appliance of claim 1, wherein the first and second electrical contacts are coated, at least in parts, with a metal.

10. The household appliance of claim 9, wherein the metal is gold or brass.

11. The household appliance of claim 1, wherein the second electrical contact is configured as an S-shaped strip.

12. The household appliance of claim 1, wherein the decoupling element pushes the housing-side second electrical contact away from the first electrical contact as the door moves into the storage place.

13. The household appliance of claim 12, wherein the decoupling element pushes the housing-side second electrical contact in a direction perpendicular to the longitudinal direction of the horizontal guide path when the decoupling element pushes the housing-side second electrical contact away from the first electrical contact as the door moves into the storage place.

* * * * *